US008279245B2

(12) United States Patent
Kim et al.

(10) Patent No.: US 8,279,245 B2
(45) Date of Patent: Oct. 2, 2012

(54) LIQUID CRYSTAL DISPLAY DEVICE

(75) Inventors: Kiduk Kim, Gyeonggi-do (KR); Euitae Kim, Seoul (KR); Joonyoung Park, Gyeonggi-do (KR); Yongwoo Choi, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 432 days.

(21) Appl. No.: 12/622,583

(22) Filed: Nov. 20, 2009

(65) Prior Publication Data

US 2010/0156965 A1 Jun. 24, 2010

(30) Foreign Application Priority Data

Dec. 18, 2008 (KR) ..... 10-2008-0129566

(51) Int. Cl.
*G09G 5/10* (2006.01)

(52) U.S. Cl. ..... 345/691; 345/76; 345/77; 345/87; 345/89; 345/204; 345/211; 345/214

(58) Field of Classification Search ..... None
See application file for complete search history.

(56) References Cited

U.S. PATENT DOCUMENTS 6,653,794 B2 * 11/2003 Sagano et al. ..... 315/169.2
6,707,437 B1 * 3/2004 Kuno et al. ..... 345/74.1
6,937,224 B1 * 8/2005 Miyachi ..... 345/102
7,265,864 B2 * 9/2007 Koshimizu et al. ..... 358/1.16
7,679,628 B2 * 3/2010 Kanai ..... 345/691
8,223,115 B2 * 7/2012 Chung et al. ..... 345/102
2002/0011979 A1 * 1/2002 Nitta et al. ..... 345/89
2004/0100451 A1 * 5/2004 Okada ..... 345/173
2005/0088379 A1 * 4/2005 Tsuchida ..... 345/76
2005/0104827 A1 * 5/2005 Baik ..... 345/87
2005/0140631 A1 * 6/2005 Oh et al. ..... 345/89
2006/0007069 A1 * 1/2006 Isono et al. ..... 345/75.1
2006/0139270 A1 * 6/2006 Hong et al. ..... 345/87
2006/0145978 A1 * 7/2006 Takatori et al. ..... 345/87
2008/0007512 A1 * 1/2008 Honbo ..... 345/102
2008/0055230 A1 * 3/2008 Jang et al. ..... 345/102
2008/0225036 A1 * 9/2008 Song et al. ..... 345/213
2010/0002009 A1 * 1/2010 Takata ..... 345/589
2010/0085375 A1 * 4/2010 Chung et al. ..... 345/589

* cited by examiner

*Primary Examiner* — Dismery Mercedes
(74) *Attorney, Agent, or Firm* — Morgan, Lewis & Bockius LLP

(57) ABSTRACT

A liquid crystal display is disclosed. The liquid crystal display includes a liquid crystal display panel; a backlight unit; a panel drive circuit; a timing controller; a data stretching unit that modulates an internal video signal using a data stretching curve determined depending on a brightness of the internal video signal for a self-screen drive; an internal memory; a self-screen drive controller; a scaler unit; a selection unit; an internal power circuit; an external power circuit; and a microprocessor that blocks an output of the external power circuit from being supplied to the scaler unit in the self-screen drive.

8 Claims, 11 Drawing Sheets

LIQUID CRYSTAL DISPLAY DEVICE

This application claims the benefit of Korea Patent Application No. 10-2008-129566 filed on Dec. 18, 2008, which is incorporated herein by reference for all purposes as if fully set forth herein.

BACKGROUND OF THE INVENTION

1. Field of the Invention

Embodiments of the invention relate to a liquid crystal display providing an interior design at low power consumption.

2. Discussion of the Related Art

Liquid crystal displays display an image by controlling a light transmittance of a liquid crystal layer through an electric field in response to a video signal. The liquid crystal display is also a flat panel display device having advantages such as a thin profile, a small size, and low power consumption. Thus, liquid crystal displays are used in personal computers such as notebook PCs, office automation equipment, audio/video equipment, and the like.

In addition, an active matrix type liquid crystal display includes a switching element formed in each liquid crystal cell. Therefore, the active matrix type liquid crystal display is advantageous for displaying a moving picture, because the switching elements can be actively controlled. Further, a thin film transistor (TFT) is used in the switching element of the active matrix type liquid crystal display.

In more detail, and with reference to FIG. 1, an active matrix type liquid crystal display converts digital video data into an analog data voltage based on a gamma reference voltage to supply the analog data voltage to a data line DL, and at the same time, to supply a scan pulse to a gate line GL. Hence, a liquid crystal cell Clc is charged to a data voltage. For the above-described operation, a gate electrode of a TFT is connected to the gate line GL, a source electrode of the TFT is connected to the data line DL, and a drain electrode of the TFT is connected to a pixel electrode of the liquid crystal cell Clc and an electrode at one side of a storage capacitor Cst. Further, a common voltage Vcom is supplied to a common electrode of the liquid crystal cell Clc.

When the TFT is turned on, the storage capacitor Cst is charged to the data voltage received from the data line DL to keep a voltage of the liquid crystal cell Clc constant. The TFT is turned on when the scan pulse is supplied to the gate line GL. Thus, a channel is formed between the source electrode and the drain electrode of the TFT, and a voltage on the data line DL is supplied to the pixel electrode of the liquid crystal cell Clc. In addition, when an arrangement state of liquid crystal molecules of the liquid crystal cell Clc changes by an electric field between the pixel electrode and the common electrode, incident light is modulated.

A liquid crystal display like a liquid crystal display television (LCD TV) generally includes a liquid crystal display panel, a backlight unit, a liquid crystal module including drive circuits and a controller, and a system module including a scaler and a power unit.

Pixels each having a structure illustrated in FIG. 1 are formed on the liquid crystal display panel. The backlight unit is mainly classified into a direct type backlight unit and an edge type backlight unit. In the edge type backlight unit, light sources are installed outside the liquid crystal display panel, and light from the light sources is incident on the entire surface of the liquid crystal display panel using a transparent light guide plate. In the direct type backlight unit, light sources are installed in the rear of the liquid crystal display panel, and light from the light sources is directly incident on the entire surface of the liquid crystal display panel. The direct type backlight unit can increase a luminance as compared with the edge type backlight unit because of the plurality of light sources. Therefore, in case of a LCD TV requiring a large-screen liquid crystal display panel, the direct type backlight unit is generally used. The drive circuits include a gate drive circuit, a data drive circuit, a backlight drive circuit, and the like. The controller includes a timing controller, and the like.

The scaler performs image processing on an image received from the outside, so that the image is suitable to be displayed on the liquid crystal module. Further, the scaler generates sync signals synchronized with the image. The power unit includes a driving power supply for driving the liquid crystal module, the scaler, and an audio device and generates a power for driving the liquid crystal display.

However, the related art liquid crystal display has the following problems. First, when the liquid crystal display is used as a TV, for example, and is mounted on a wall, the liquid crystal display has a dark or black appearance when it is not used. Further, many liquid crystal displays are large in size, and thus the liquid crystal display has an unattractive appearance when it is not being used, especially when the liquid crystal display is used in a home, office, work environment, etc. In addition, the amount of power consumption used by display has greatly increased especially with a trend of large sized and high definition (HD) liquid crystal displays. The high power consumption disadvantageously affects liquid crystal displays.

SUMMARY OF THE INVENTION

Embodiments of the invention provide a liquid crystal display capable of providing an interior design at low power consumption.

In one aspect, there is a liquid crystal display comprising a liquid crystal display panel, a backlight unit that provides light to the liquid crystal display panel, a panel drive circuit that drives signal lines of the liquid crystal display panel, a timing controller that supplies a video signal to the panel drive circuit and controls an operation timing of the panel drive circuit, a data stretching unit that modulates an internal video signal using a data stretching curve determined depending on a brightness of the internal video signal for a self-screen drive, an internal memory that stores the modulated internal video signal, a self-screen drive controller that generates a dimming signal having a dimming ratio less than a dimming ratio in a normal drive to reduce a luminance of the backlight unit and generates an internal timing signal to extract the modulated internal video signal, a scaler unit that generates an external video signal for the normal drive and an external timing signal, a selection unit that supplies one of an output of the self-screen drive controller and an output of the scaler unit to the timing controller in response to a mode selection signal, an internal power circuit that generates driving voltages required to drive the panel drive circuit, the timing controller, and the self-screen drive controller, an external power circuit that generates a power input to the internal power circuit and generates a power of circuits constituting the scaler unit, and a microprocessor that blocks an output of the external power circuit from being supplied to the scaler unit in the self-screen drive.

The data stretching unit fixes a slope of lower gray level, calculates an average luminance of the internal video signal corresponding to 1 frame, adjusts a slope of upper gray level between a previously set minimum slope and a previously set maximum slope depending on the calculated average luminance, and connects the fixed slope of lower gray level and the adjusted slope of upper gray level to determine a data stretching curve.

The data stretching curve determined when the average luminance has a minimum value includes a first lower gray level curve including a first lower gray level range between a minimum gray level and a first middle gray level, a gray level on the first lower gray level curve changing between the minimum gray level and the first middle gray level at a fixed slope, and a first upper gray level curve that includes a first upper gray level range between the first middle gray level and a maximum gray level and is connected to the first lower gray level curve at a first intersecting point, a gray level on the first upper gray level curve changing between the first middle gray level and the maximum gray level at the previously set minimum slope less than the fixed slope.

The data stretching curve determined when the average luminance has a maximum value includes a second lower gray level curve including a second lower gray level range between the minimum gray level and a second middle gray level less than the first middle gray level, a gray level on the second lower gray level curve changing between the minimum gray level and the second middle gray level at the fixed slope and a second upper gray level curve that includes a second upper gray level range between the second middle gray level and the maximum gray level and is connected to the second lower gray level curve at a second intersecting point, a gray level on the second upper gray level curve changing between the second middle gray level and the maximum gray level at the previously set maximum slope that is less than the fixed slope and is greater than the previously set minimum slope.

The data stretching unit analyzes a histogram of the internal video signal corresponding to 1 frame to calculate a reference gray level falling from a maximum gray level to T % (where T is a natural number equal to or less than 5), calculates an average luminance of the internal video signal corresponding to 1 frame, adjusts a slope of upper gray level between a previously set minimum slope and a previously set maximum slope depending on the calculated average luminance, and connects the reference gray level on an upper gray level curve to a minimum gray level point to determine a data stretching curve.

The data stretching curve determined when the average luminance has a minimum value includes a first lower gray level curve including a first lower gray level range between a minimum gray level and the reference gray level, a gray level on the first lower gray level curve changing between the minimum gray level and the reference gray level at a first slope and a first upper gray level curve that includes a first upper gray level range between the reference gray level and the maximum gray level and is connected to the first lower gray level curve at a first intersecting point, a gray level on the first upper gray level curve changing between the reference gray level and the maximum gray level at the previously set minimum slope less than the first slope.

The data stretching curve determined when the average luminance has a maximum value includes a second lower gray level curve including a second lower gray level range equal to the first lower gray level range, a gray level on the second lower gray level curve changing between the minimum gray level and the reference gray level at a second slope less than the first slope and a second upper gray level curve that includes a second upper gray level range equal to the first upper gray level range and is connected to the second lower gray level curve at a second intersecting point, a gray level on the second upper gray level curve changing between the reference gray level and the maximum gray level at the previously set maximum slope that is less than the second slope and is greater than the previously set minimum slope.

The liquid crystal display further comprises a plurality of touch sensors generating the mode selection signal in response to a user's touch operation.

A dimming ratio of the dimming signal increases within a power consumption of 10% of a power consumption of the backlight unit operating at a maximum dimming ratio in the normal drive as an external illuminance increases.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Reference will now be made in detail embodiments of the invention examples of which are illustrated in the accompanying drawings.

Figure 1:
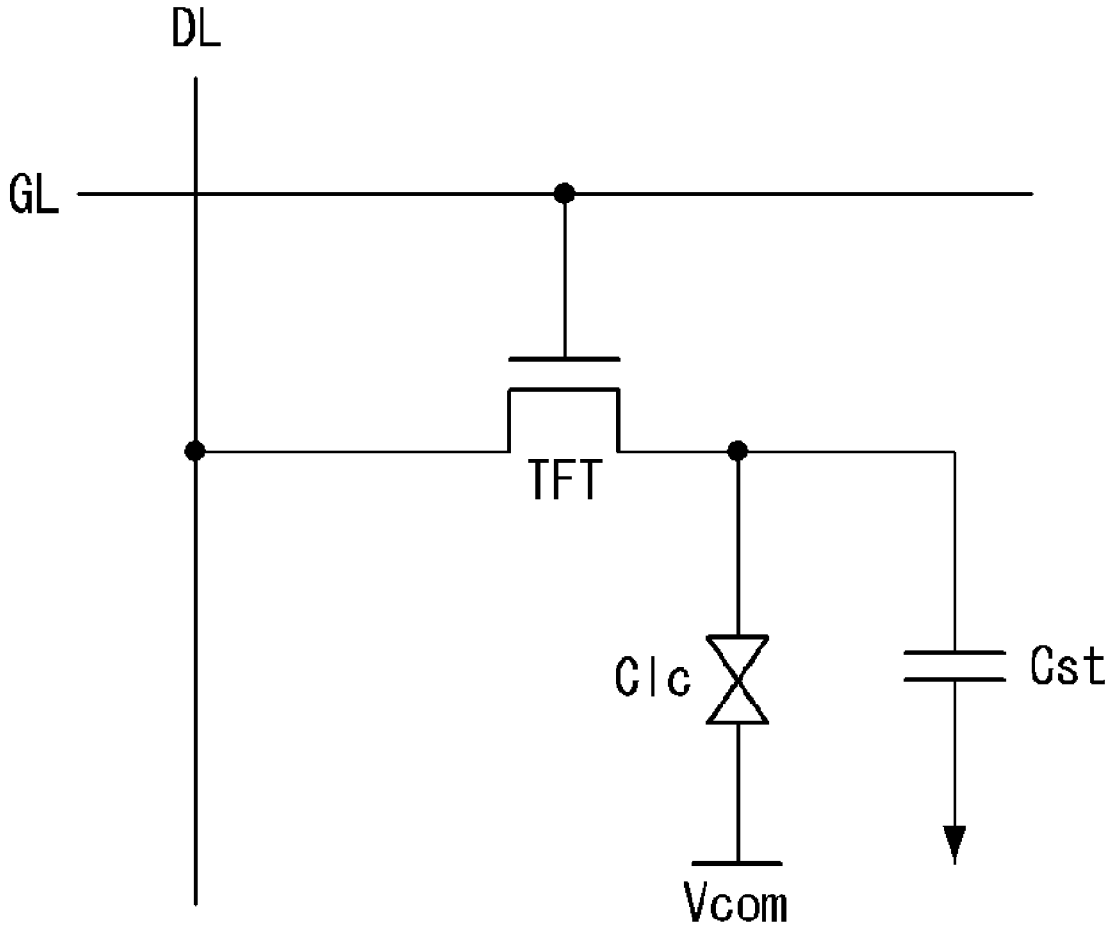
FIG. 1 (Related Art)
FIG. 1 is an equivalent circuit diagram of a pixel of a related art liquid crystal display.
Figure 2:
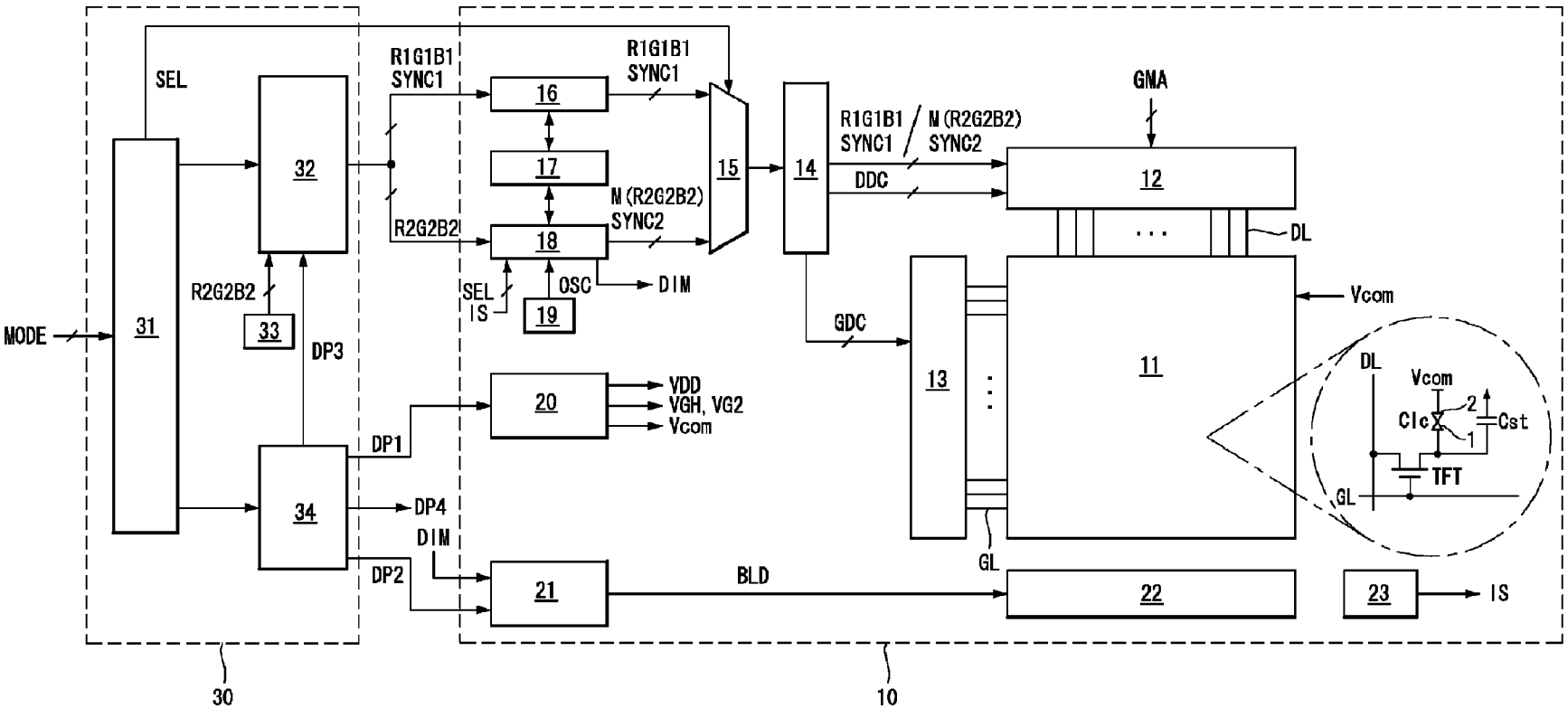
FIG. 2 is a block diagram of a liquid crystal display according to an embodiment of the invention.

FIG. 2 is a block diagram of a liquid crystal display according to an embodiment of the invention.

As shown in FIG. 2, the liquid crystal display includes a liquid crystal module 10 displaying an image and a system module 30 supplying a driving signal to the liquid crystal module 10.

The liquid crystal module 10 includes a liquid crystal display panel 11, a data drive circuit 12, a gate drive circuit 13, a timing controller 14, a multiplexer 15, a first controller 16, an internal memory 17, a second controller 18, an oscillator 19, a DC-DC converter 20, a backlight drive circuit 21, and a backlight unit 22. Also, the liquid crystal module 10 may further include an illuminance sensing unit 23.

The liquid crystal display panel 11 includes an upper glass substrate, a lower glass substrate, and a liquid crystal layer between the upper and lower glass substrates. The liquid crystal display panel 11 includes mxn liquid crystal cells Clc arranged in a matrix format at each crossing of m data lines DL and n gate lines GL.

The data lines DL, the gate lines GL, thin film transistors (TFTs), and a storage capacitor Cst are formed on the lower glass substrate of the liquid crystal display panel 11. The liquid crystal cells Clc are connected to the TFTs and are driven by an electric field between pixel electrodes 1 and common electrodes 2. A black matrix, a color filter, and the common electrodes 2 are formed on the upper glass substrate of the liquid crystal display panel 11. The common electrode 2 is formed on the upper glass substrate in a vertical electric drive manner, such as a twisted nematic (TN) mode and a vertical alignment (VA) mode. The common electrode 2 and the pixel electrode 1 are formed on the lower glass substrate in a horizontal electric drive manner, such as an in-plane switching (IPS) mode and a fringe field switching (FFS) mode. Polarizing plates are attached respectively to the upper and lower glass substrates. Alignment layers for setting a pre-tilt angle of the liquid crystal are respectively formed on the upper and lower glass substrates.

The data drive circuit 12 converts an external video signal (hereinafter, referred to as first digital video data R1G1B1) for a normal drive or a modulation video signal (hereinafter, referred to as modulation digital video data M(R2G2B2)) modulated from an internal video signal (hereinafter, referred to as second digital video data R2G2B2) for a self-screen drive into an analog gamma compensation voltage based on gamma reference voltages GMA received from a gamma reference voltage generation circuit (not shown) in response to a data control signal DDC received from the timing controller 14 to supply the analog gamma compensation voltage as a data voltage to the data lines DL of the liquid crystal display panel 11. For the above-described operation, the data drive circuit 12 includes a plurality of data drive integrated circuits (ICs) each including a shift resistor, a resistor, a latch, a digital-to-analog converter (DAC), a multiplexer, an output buffer, and so on. The shift resistor samples a clock signal, and the resistor temporarily stores the first digital video data R1G1B1 or the modulation digital video data M(R2G2B2). The latch stores the digital video data R1G1B1/M(R2G2B2) every 1 line in response to the clock signal sampled by the shift resistor and simultaneously outputs the stored digital video data R1G1B1/M(R2G2B2) of each line. The DAC selects a positive or negative gamma voltage based on a gamma reference voltage in response to a digital data value from the latch. The multiplexer selects the data lines DL receiving analog data converted from the positive/negative gamma voltage. The output buffer is connected between the multiplexer and the data lines DL.

The gate drive circuit 13 sequentially supplies a scan pulse for selecting horizontal lines of the liquid crystal display panel 11, to which the data voltage will be supplied, to the gate lines GL. For the above operation, the gate drive circuit 13 includes a plurality of gate drive ICs each including a shift resistor, a level shifter for shifting an output signal of the shift resistor to a swing width suitable for a TFT drive of the liquid crystal cell Clc, and an output buffer connected between the level shifter and the gate lines GL.

The timing controller 14 receives timing signals, such as an external timing signal (hereinafter, referred to as a first sync signal SYNC1) or an internal timing signal (hereinafter, referred to as a second sync signal SYNC2) to generate a data timing control signal DDC for controlling operation timing of the data drive circuit 12 and a gate timing control signal GDC for controlling operation timing of the gate drive circuit 13. The data timing control signal DDC includes a source sampling clock signal SSC indicating a latch operation of digital data inside the data drive circuit 12 based on a rising or falling edge, a source output enable signal SOE indicating an output of the data drive circuit 12, a polarity control signal POL indicating a polarity of the data voltage to be supplied to the liquid crystal cells Clc of the liquid crystal display panel 11, and the like. The gate timing control signal GDC includes a gate start pulse GSP, a gate shift clock signal GSC, a gate output enable signal GOE, and the like. The gate start pulse GSP indicates a start horizontal line of a scan operation during 1 vertical period in which one screen is displayed. The gate shift clock signal GSC is a timing control signal that is input to the shift resistor of the gate drive circuit 13 to sequentially shift the gate start pulse GSP, and has a pulse width corresponding to on-period of a thin film transistor (TFT). The gate output enable signal GOE indicates an output of the gate drive circuit 13.

Further, the timing controller 14 rearranges the first digital video data R1G1B1 or the modulation digital video data M(R2G2B2) in conformity with a resolution of the liquid crystal display panel 11 to supply the rearranged first digital video data R1G1B1 or the rearranged modulation digital video data M(R2G2B2) to the data drive circuit 12.

The multiplexer 15 selects one of an output signal (i.e., R1G1B1 and SYNC1) of the first controller 16 and an output signal (i.e., M(R2G2B2) and SYNC2) of the second controller 18 in response to a selection signal SEL received from the system module 30 to supply the selected output signal to the timing controller 14. For example, if the multiplexer 15 selects the output signals R1G1B1 and SYNC1 of the first controller 16 in response to the selection signal SEL of a first logic level, the liquid crystal module 10 operates in a normal drive mode. On the other hand, if the multiplexer 15 selects the output signals M(R2G2B2) and SYNC2 of the second controller 18 in response to the selection signal SEL of a second logic level, the liquid crystal module 10 operates in a self-screen drive mode.

The first controller 16 controlling a normal drive supplies the first digital video data R1G1B1 and the first sync signal SYNC1 received from the system module 30 to one input terminal of the multiplexer 15. The first controller 16 may include at least one of a first modulation unit for improving a response characteristic of the liquid crystal display panel 11 and a second modulation unit for emphasizing a contrast ratio of the liquid crystal display panel 11. The first modulation unit compares previous frame data with current frame data and determines changes in the frame data depending on a comparison result. Then, the first modulation unit extracts a first compensation value according to a determining result from the internal memory 17 and modulates the first digital video data R1G1B1 using the first compensation value. Thus, the response characteristic of the liquid crystal display panel 11 can be improved. The first modulation unit may achieve a fast response time of the liquid crystal display panel 11 using a modulation method disclosed in detail in Korea Patent Application Nos. 10-2001-0032364 and 10-2001-0057119 corresponding to the present applicant, and which are hereby incorporated by reference in their entirety.

The second modulation unit analyzes a luminance of the first digital video data R1G1B1 corresponding to one screen. Then, the second modulation unit modulates the first digital video data R1G1B1 using second compensation values stored in the internal memory 17 depending on an analyzing result of luminance to increase a luminance of the first digital video data R1G1B1 to be used in a bright portion of an image and to reduce a luminance of the first digital video data R1G1B1 to be used in a dark portion of the image. At the same time, the second modulation unit controls a luminance of the backlight unit 22 depending on the analyzing result of luminance, so that a brightness of light sources of the backlight unit 22 providing light to the bright portion of the image increases and a brightness of light sources of the backlight unit 22 providing light to the dark portion of the image decreases. As a result, the second modulation unit modulates the luminance of the first digital video data R1G1B1, and at the same time, controls the luminance of the backlight unit 22 to thereby increase a luminance and a contrast ratio of the image. Hence, a dynamic contrast ratio of a moving picture displayed on the liquid crystal display increases. The second modulation unit may increase the contrast ratio of the liquid crystal display panel 11 using a modulation method disclosed in detail in Korea Patent Application Nos. 10-2003-0099334 and 10-2004-0030334 corresponding to the present applicant, and which are hereby incorporated by reference in their entirety.

In the normal drive, the internal memory 17 stores compensation values for improving the response characteristic and the contrast ratio of the liquid crystal display panel 11 in the form of a lookup table. In the self-screen drive, the internal memory 17 stores the modulation digital video data M(R2G2B2) corresponding to k frames (where k is an integer equal to or greater than 1) to be displayed. In addition, in the self-screen drive, the internal memory 17 may store dimming signals DIM for reducing power consumption depending on an external illuminance in the form of a lookup table. The dimming signal DIM is a control signal for controlling a turned-on period of the light sources. It is preferable that a dimming ratio in the self-screen drive is much less than a dimming ratio in the normal drive so as to reduce power consumption in the self-screen drive. For example, supposing that power consumption of the light sources having a maximum dimming ratio in the normal drive is 100%, a brightness of the dimming signal DIM in the self-screen drive may be set within the range of power consumption of 10%. In addition, a dimming ratio of the dimming signal DIM in the self-screen drive increases as an external illuminance increases within the range of power consumption of 10%, so that the dimming signal DIM secures visibility.

The oscillator 19 generates an oscillation clock OSC.

The second controller 18 controlling the self-screen drive operates in response to the selection signal SEL of the second logic level received from the system module 30. The second controller 18 modulates the second digital video data R2G2B2 into the modulation digital video data M(R2G2B2) using a data stretching curve determined depending on a luminance of the second digital video data R2G2B2 and then stores the modulation digital video data M(R2G2B2) in the internal memory 17, so as to relieve a banding phenomenon of a gray scale resulting from a reduction in the brightness of the light sources and to increase an average luminance of a display image. In addition, the second controller 18 repeatedly performs the modulation and storing operations in conformity with an update cycle of the second digital video data R2G2B2 received from the system module 30. The second controller 18 generates the second sync signal SYNC2 being a self-screen sync signal for the self-screen drive based on the oscillation clock OSC received from the oscillator 19. The second controller 18 extracts the modulation digital video data M(R2G2B2), that is synchronized with the second sync signal SYNC2 and is stored in the internal memory 17, and then supplies the extracted modulation digital video data M(R2G2B2) and the second sync signal SYNC2 to another input terminal of the multiplexer 15. The second controller 18 extracts the dimming signal DIM for controlling the luminance of the backlight unit 22 from the internal memory 17 based on an illuminance signal IS received from the illuminance sensing unit 23. The second controller 18 will be in detail described later with reference to FIGS. 3 to 6C.

The DC-DC converter 20 is an internal power supply circuit. The DC-DC converter 20 increases or reduces a first driving power DP1 received from the system module 30 to generate a plurality of voltages that will be supplied to the liquid crystal display panel 11. Examples of the voltages generated by the DC-DC converter 20 include VDD voltage, Vcom voltage, VGH voltage equal to or greater than 15V, and VGL voltage equal to or less than −4V. The VDD voltage is supplied to a gamma resistance string of the data drive circuit 12, so that the data drive circuit 12 generates the analog gamma compensation voltage. The Vcom voltage is a voltage supplied to the common electrode 2 formed on the liquid crystal display panel 11 via the date drive circuit 12. The VGH voltage is a high logic voltage of the scan pulse, that is set at a value equal to or greater than a threshold voltage of the TFT, and is supplied to the gate drive circuit 13. The VGL voltage is a low logic voltage of the scan pulse, that is set at an off-voltage of the TFT, and is supplied to the gate drive circuit 13.

The backlight drive circuit 21 generates a backlight driving signal BLD using a second driving power DP2 received from the system module 30 to drive the backlight unit 22 using the backlight driving signal BLD. In particular, the backlight drive circuit 21 generates the backlight driving signal BLD based on the dimming signal DIM received from the second controller 18 in the self-screen drive mode. The backlight driving signal BLD in the self-screen drive mode may reduce the luminance of the backlight unit 22 as compared with the normal drive mode. The backlight drive circuit 21 may include an inverter or a light emitting diode (LED) driver depending on a kind of light source constituting the backlight unit 22.

The backlight unit 22 includes a plurality of light sources or a plurality of LEDs, a side supporter, a bottom cover, a diffusion plate, a reflective sheet, and a plurality of optical sheets. Examples of the light source used in the backlight unit 22 include a cold cathode fluorescent lamp (CCFL) and an external electrode fluorescent Lamp (EEFL). The backlight driving signal BLD is generated by the inverter. In addition, if an LED is used as the light source of the backlight unit 22, the backlight driving signal BLD supplied to the LED is generated by the LED driver.

The illuminance sensing unit 23 includes one optical sensor or a plurality of optical sensors. The illuminance sensing unit 23 senses an external illuminance of an environment around the liquid crystal module 10 to generate the illuminance signal IS. The optical sensor constituting the illuminance sensing unit 23 is exposed and attached to the outside of the liquid crystal module 10. Otherwise, the optical sensor may be mounted at one side of the liquid crystal display panel 11 through a TFT process.

The system module 30 includes a microprocessor 31, a scaler unit 32, an external memory 33, and a power unit 34.

The microprocessor 31 checks a mode signal MODE input through a user interface such as a remote controller and a selection button, controls a power supply according to a check result, and generates the selection signals SEL of the first logic level or the selection signals SEL of the second logic level. More specifically, if the microprocessor 31 receives the mode signal MODE indicating the normal drive, the microprocessor 31 allows all of powers including the powers DP1 to DP3 to be supplied to the liquid crystal module 10 and the system module 30 through the control of the power unit 34 and generates the selection signal SEL of the first logic level. On the other hand, if the microprocessor 31 receives the mode signal MODE indicating the self-screen drive, the microprocessor 31 turns off all of powers (for example, the power DP3 used to drive the scaler unit 32 and the power DP4 used to drive an audio device) except the powers DP1 and DP2 supplied to the liquid crystal module 10 through the control of the power unit 34 and generates the selection signal SEL of the second logic level opposite the first logic level. In addition, the microprocessor 31 allows new second digital video data R2G2B2 used in data update to be extracted from the external memory 33 through the control of the power unit 34, so that a power is periodically supplied to the scaler unit 32 even in the self-screen mode. For this, the microprocessor 31 may include a counter unit that counts driving time and outputs a timing signal indicating an update timing every predetermined period of time. If the microprocessor 31 does not receive the mode signal MODE through the user interface, the microprocessor 31 turns off all of the powers including the powers supplied to the liquid crystal module 10 and the system module 30 through the control of the power unit 34. Hence, the microprocessor 31 allows the liquid crystal display to operate in a standby mode.

The scaler unit 32 includes an interface circuit and a graphic processing circuit. The interface circuit transfers video data of various attributes received from a storing medium such as DVD, CD, and HDD, a TV receiving circuit, etc. to the graphic processing circuit. The graphic processing circuit includes an analog-to-digital convertor (ADC) converting analog video data into digital video data, a scaler converting the digital video data in conformity with a resolution, an image processing unit compensating for a reduction in image quality resulting from changes in a resolution through a signal interpolation method, and the like. The graphic processing circuit converts the video data received from the interface circuit into the first digital video data R1G1B1 suitable for the liquid crystal display panel 11. Further, the graphic processing circuit extracts a complex video signal based on the digital video data and generates the first sync signal SYNC1 suitable for a resolution of the liquid crystal display panel 11 using the extracted complex video signal. The first sync signal SYNC1 includes a first dot clock DCLK1, a first vertical sync signal Vsync1, a first horizontal sync signal Hsync1, a first data enable signal DE1, and the like. The first digital video data R1G1B1 and the first sync signal SYNC1 generated by the graphic processing circuit are supplied to the first controller 16 of the liquid crystal module 10. The scaler unit 32 extracts new second digital video data R2G2B2, that is used to update data every predetermined period of time in the self-screen mode, from the external memory 33 under the control of the microprocessor 31 to supply the new second digital video data R2G2B2 to the second controller 18 of the liquid crystal module 10.

The external memory 33 includes data update and erasable nonvolatile memory, for example, electrically erasable programmable read-only memory (EEPROM) and/or extended display identification data (EDID) ROM. The external memory 33 stores new second digital video data R2G2B2 used to update a display image in the self-screen drive mode. The second digital video data R2G2B2 may be updated by an electrical signal received from the outside through the user interface.

The power unit 34 is an external power circuit and generates the first driving power DP1 required to operate the DC-DC converter 20, the second driving power DP2 required to operate the backlight drive circuit 21, the third driving power DP3 required to operate the scaler unit 32, and the fourth driving power DP4 required to operate other devices including the audio device. The power unit 34 performs or cuts off a power supply under the control of the microprocessor 31.

Figure 3:
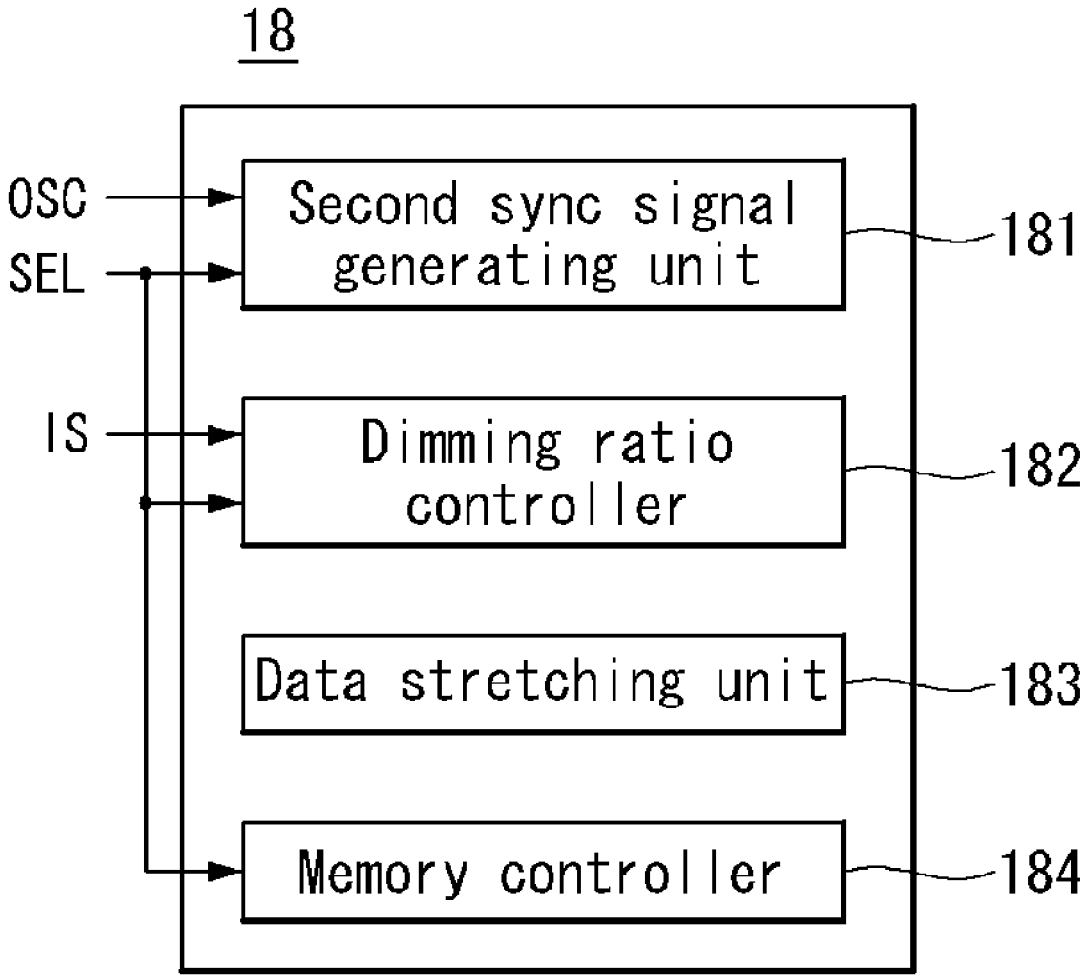
FIG. 3 illustrates a second controller.
Figure 4:
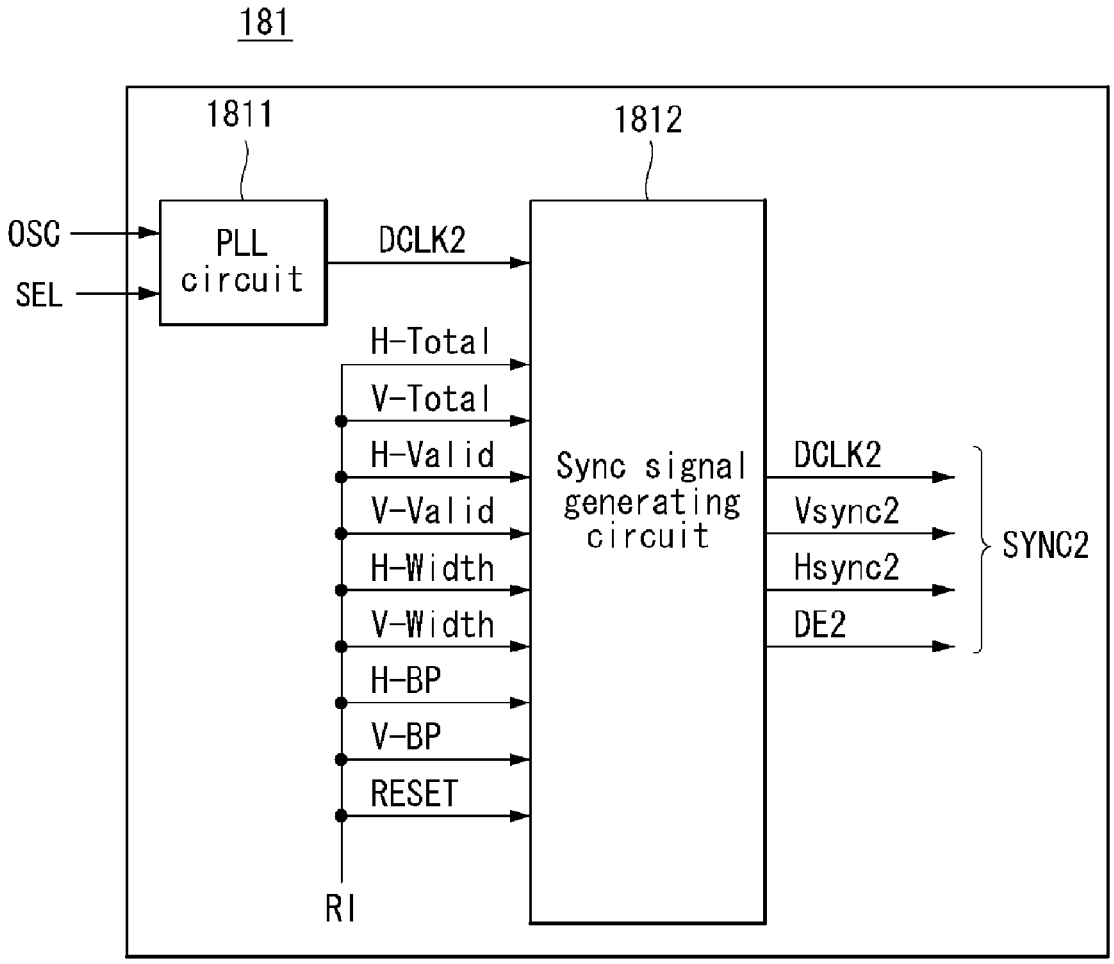
FIG. 4 illustrates a second sync signal generating unit.

FIGS. 3 and 4 illustrate the second controller 18.

As shown in FIG. 3, the second controller 18 includes a second sync signal generating unit 181, a dimming ratio controller 182, a data stretching unit 183, and a memory controller 184.

The second sync signal generating unit 181 generates the second sync signal SYNC2 for the self-screen drive based on resolution information RI of the liquid crystal display panel 11 in response to the selection signal SEL of the second logic level and the oscillation clock OSC received from the oscillator 19. If the liquid crystal display panel 11 is driven at a frame frequency having F-value in the normal drive, the second sync signal SYNC2 is synchronized with a minimum driving frequency, at which a flicker is invisible, among frame frequencies less than a frame frequency of F/2, so as to reduce the power consumption. For example, if the liquid crystal display panel 11 is driven at a frame frequency of 120 Hz in the normal drive, the second sync signal SYNC2 for the self-screen drive may be synchronized with the minimum driving frequency (i.e., a frame frequency of 50 Hz) to the extent that the flicker is invisible. For this, the second sync signal generating unit 181, as shown in FIG. 4, includes a phase locked loop (PLL) circuit 1811 and a sync signal generating circuit 1812.

The PLL circuit 1811 includes a well-known PLL including a voltage controlled oscillator (VCO), a divider, a temperature compensated X-tal oscillator (TCXO), a phase detector, a charge pump, and a loop filter. The PLL circuit 1811 generates a second dot clock DCLK2 using the oscillation clock OSC.

The sync signal generating circuit 1812 generates the second sync signal SYNC2 (including the second dot clock DCLK2, a second vertical sync signal Vsync2, a second horizontal sync signal Hsync2, a second data enable signal DE2, and the like) in conformity with a resolution of the liquid crystal display panel 11 using the second dot clock DCLK2 and the resolution information RI. The resolution information RI includes a total of horizontal period H_Total, a total of vertical period V_Total, a horizontal valid period H_Valid, a vertical valid period V_Valid, a horizontal widt H_Width, a vertical width V_Width, a horizontal back porch H_BP, a vertical back porch V_BP, and a reset signal RESET.

The dimming ratio controller 182 generates the dimming signal DIM for reducing the luminance of the backlight unit 22 in response to the selection signal SEL of the second logic level. For this, the dimming ratio controller 182 extracts the dimming signal DIM from the internal memory 17 using the illuminance signal IS from the illuminance sensing unit 23 as a read address. Supposing that power consumption of the light sources having a maximum dimming ratio in the normal drive is 100%, a brightness of the light sources in the self-screen drive may be set within the range of power consumption of 10% by the dimming signal DIM. In addition, a dimming ratio of the dimming signal DIM in the self-screen drive increases as an external illuminance increases within the range of power consumption of 10%, so that the dimming signal DIM secures visibility within the range of power consumption of 10%.

The data stretching unit 183 modulates the second digital video data R2G2B2 into the modulation digital video data M(R2G2B2) using a data stretching curve determined depending on a luminance of the second digital video data R2G2B2 corresponding to 1 frame. The data stretching unit 183 may determine the data stretching curve using various methods.

Figure 5A:
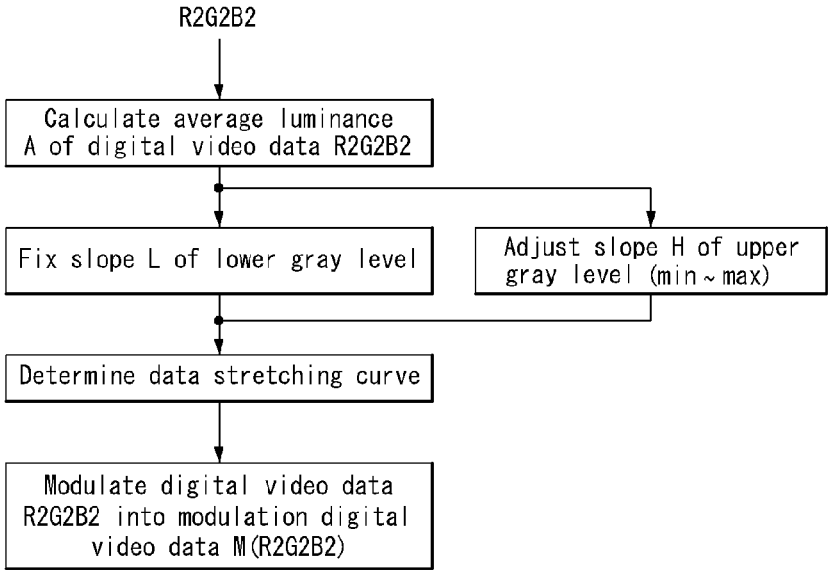
FIGS. 5A and 5B illustrate an example of determining a data stretching curve in a data stretching unit.
Figure 5B:
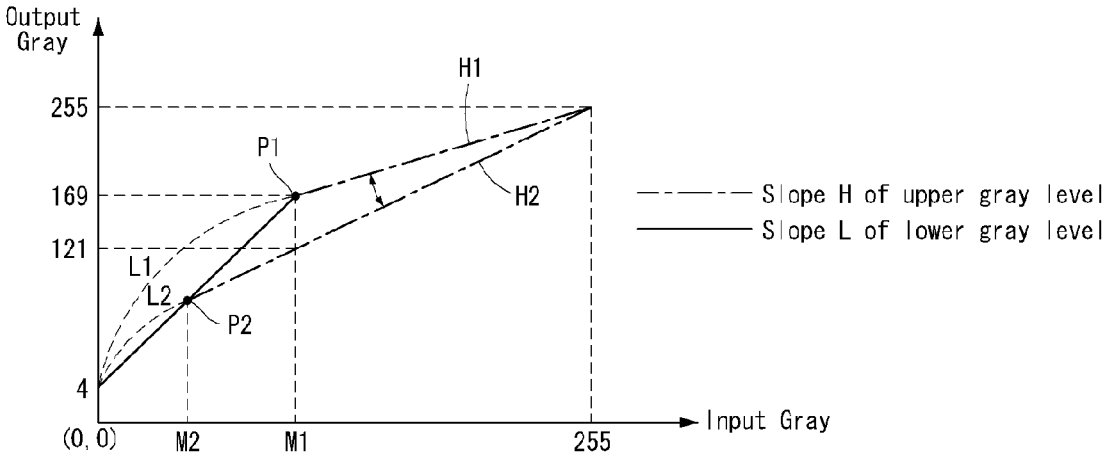

As an example, as shown in FIGS. 5A and 5B, the data stretching unit 183 fixes a slope L of lower gray level and then calculates an average luminance A of the second digital video data R2G2B2 corresponding to 1 frame. Then, the data stretching unit 183 adjusts a slope H of upper gray level between a previously set minimum slope MIN and a previously set maximum slope MAX depending on the calculated average luminance A. Then, the data stretching unit 183 determines a data stretching curve at an intersecting point P1 or P2 of the fixed slope L of lower gray level and the adjusted slope H of upper gray level. A slope of the data stretching curve is determined as (output gray level/input gray level). The slope L of lower gray level is fixed at a value (for example, 1.41) greater than 1, and the slope H of upper gray level is adjusted at a value less than 1, for example, within the range between 0.625 and 0.969.

The data stretching curve determined when the average luminance A has a minimum value includes a first lower gray level curve L1 and a first upper gray level curve H1. The first lower gray level curve L1 includes a first lower gray level range between a minimum gray level of 0 and a first middle gray level M1, and a gray level on the first lower gray level curve L1 changes between minimum gray level 0 and the first middle gray level M1 at a fixed slope of 1.41. The first upper gray level curve H1 includes a first upper gray level range between the first middle gray level M1 and maximum gray level 255 and is connected to the first lower gray level curve L1 at the first intersecting point P1, and a gray level on the first upper gray level curve H1 changes between the first middle gray level M1 and maximum gray level 255 at a minimum slope of 0.625 less than fixed slope 1.41. According to the determined data stretching curve, a dynamic range of a lower gray level increases instead of reducing a dynamic range of an upper gray level in a dark image. Thus, a banding phenomenon of gray scale at a relatively low gray level may be relieved, and an average luminance of a display image may increase because of a compensation of a luminance of a middle gray level.

The data stretching curve determined when the average luminance A has a maximum value includes a second lower gray level curve L2 and a second upper gray level curve H2. The second lower gray level curve L2 includes a second lower gray level range between minimum gray level 0 and a second middle gray level M2 less than the first middle gray level M1, and a gray level on the second lower gray level curve L2 changes between minimum gray level 0 and the second middle gray level M2 at fixed slope 1.41. The second upper gray level curve H2 includes a second upper gray level range between the second middle gray level M2 and maximum gray level 255 and is connected to the second lower gray level curve L2 at the second intersecting point P2, and a gray level on the second upper gray level curve H2 changes between the second middle gray level M2 and maximum gray level 255 at a maximum slope of 0.969 less than fixed slope 1.41. Because a dynamic range of an upper gray level increases in a bright image according to the determined data stretching curve, a degradation of an image resulting from data stretching may be minimized.

Figure 6A:
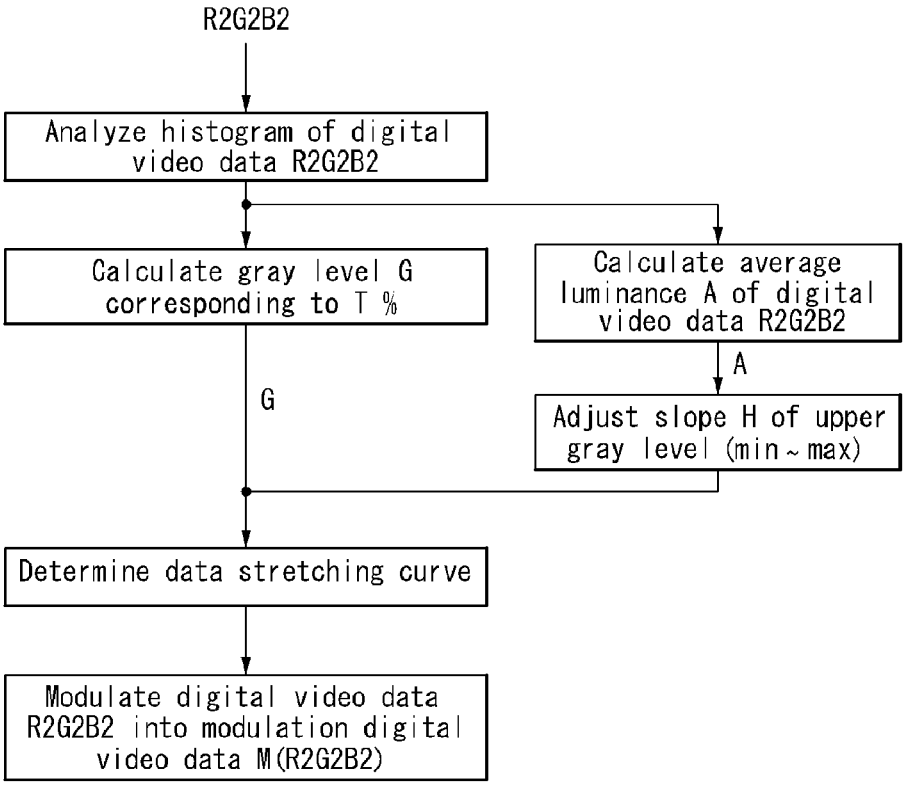
FIGS. 6A to 6C illustrate another example of determining a data stretching curve in a data stretching unit.
Figure 6B:
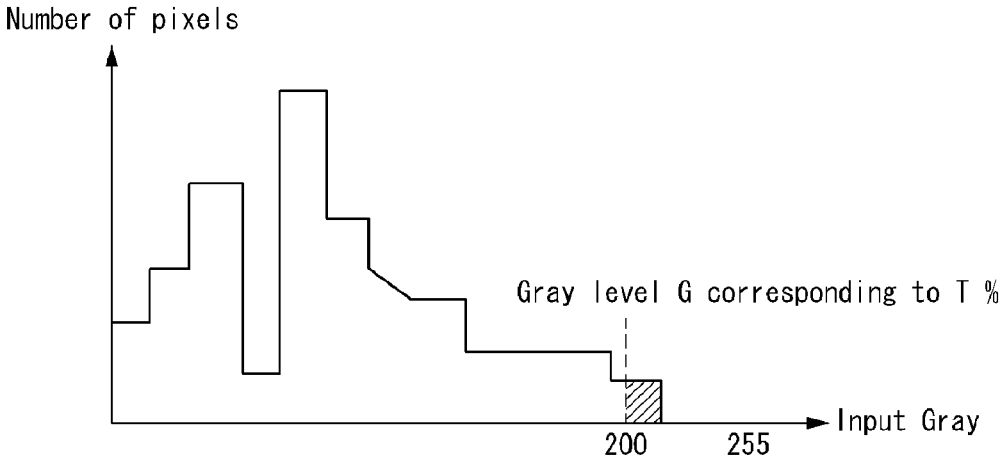
Figure 6C:
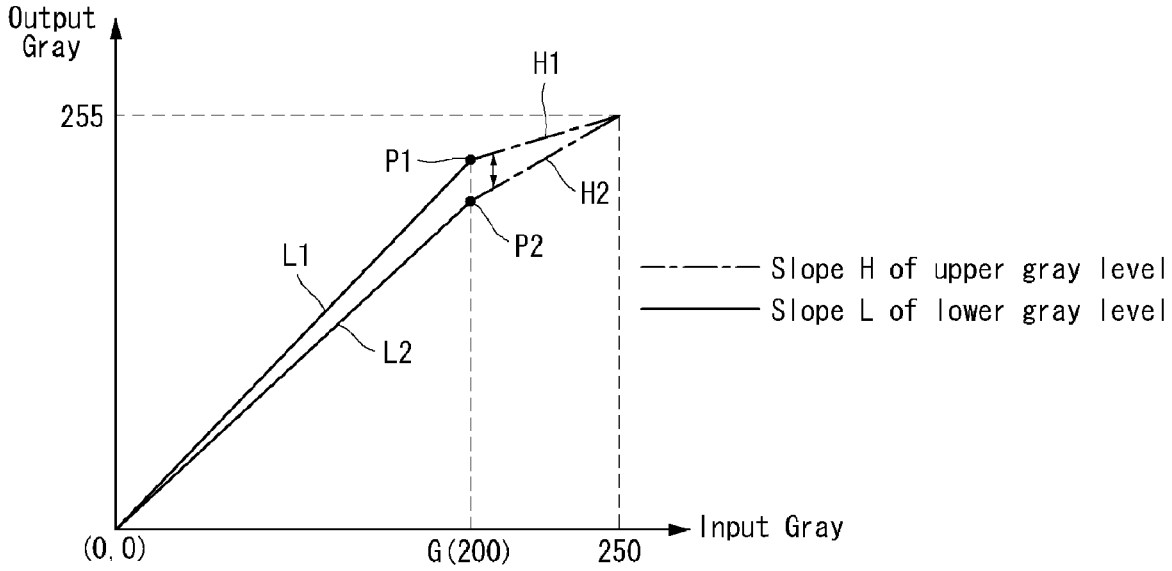

As another example, as shown in FIGS. 6A to 6C, the data stretching unit 183 analyzes a histogram of the second digital video data R2G2B2 corresponding to 1 frame to calculate a gray level G falling from a maximum gray level to T % (where T is a natural number equal to or less than 5) and then calculates an average luminance A of the second digital video data R2G2B2 corresponding to 1 frame. Then, the data stretching unit 183 adjusts a slope H of upper gray level between a previously set minimum slope MIN and a previously set maximum slope MAX depending on the calculated average luminance A. Then, the data stretching unit 183 connects the gray level G on an upper gray level curve to a minimum gray level point (0, 0) to determine a data stretching curve. A slope of the data stretching curve is determined as (output gray level/input gray level). The slope H of upper gray level has a maximum value when the average luminance A has a maximum value and has a minimum value when the average luminance A has a minimum value. It is preferable that T % is set within 5% so as to minimize a degradation of an image resulting from the data stretching.

The data stretching curve determined when the average luminance A has a minimum value includes a first lower gray level curve L1 and a first upper gray level curve H1. The first lower gray level curve L1 includes a first lower gray level range between minimum gray level 0 and the calculated gray level G, and a gray level on the first lower gray level curve L1 changes between minimum gray level 0 and the calculated gray level G at a first slope. The first upper gray level curve H1 includes a first upper gray level range between the calculated gray level G and maximum gray level 255 and is connected to the first lower gray level curve L1 at a first intersecting point P1, and a gray level on the first upper gray level curve H1 changes between the calculated gray level G and maximum gray level 255 at a minimum slope less than the first slope. According to the determined data stretching curve, a dynamic range of a lower gray level increases instead of reducing a dynamic range of an upper gray level in a dark image. Thus, a banding phenomenon of gray scale at a relatively low gray level and a middle gray level may be relieved, and an average luminance of a display image may increase. Further, because the upper gray level range decreases according to the determined data stretching curve, a degradation of an image at a high gray level resulting from the data stretching is less than the image degradation in FIGS. 5A and 5B.

The data stretching curve determined when the average luminance A has a maximum value includes a second lower gray level curve L2 and a second upper gray level curve H2. The second lower gray level curve L2 includes a second lower gray level range between minimum gray level 0 and the calculated gray level G, and a gray level on the second lower gray level curve L2 changes between minimum gray level 0 and the calculated gray level G at a second slope less than the first slope. The second upper gray level curve H2 includes a second upper gray level range between the calculated gray level G and maximum gray level 255 and is connected to the second lower gray level curve L2 at a second intersecting point P2, and a gray level on the second upper gray level curve H2 changes between the calculated gray level G and maximum gray level 255 at a maximum slope less than the second slope. Because a dynamic range of an upper gray level increases in a bright image according to the determined data stretching curve, a degradation of an image resulting from data stretching may be minimized.

The memory controller 184 controls the internal memory 17 in response to the selection signal SEL of the second logic level to extract the modulation digital video data M(R2G2B2) synchronized with the second sync signal SYNC2.

Figure 7:
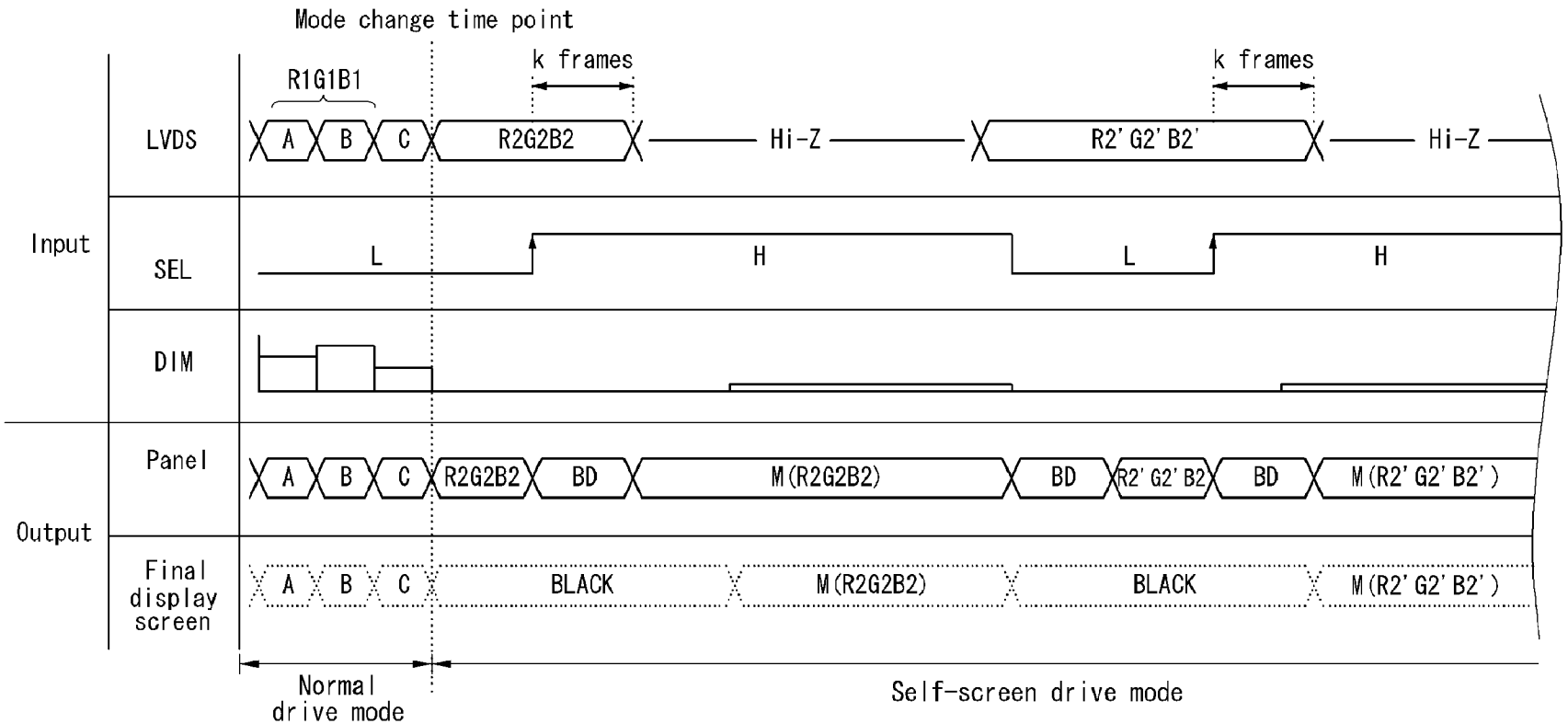
FIG. 7 is a timing diagram illustrating an interface manner between a system module and a liquid crystal module.

FIG. 7 is a timing diagram illustrating an interface manner between the system module 30 and the liquid crystal module 10. An interface circuit for the self-screen drive is the same as an interface circuit for the normal drive. In FIG. 7, HI-Z means a period where there is no signal transferred through the interface circuit for the self-screen drive.

Referring to FIGS. 2 and 7, the first controller 16 synchronizes the first digital video data R1G1B1 received from the system module 30 through a low voltage differential signaling (LVDS) circuit with the first sync signal SYNC1 to display the first digital video data R1G1B1 on the liquid crystal display panel 11 in response to the mode signal MODE indicating the normal drive. The above-described data display method is a driving method in a general TV watching state and requires very high power consumption.

On the other hand, while the second controller 18 displays a black image BLACK for removing a screen noise on the liquid crystal display panel 11 in response to the mode signal MODE indicating the self-screen drive, the second controller 18 modulates the second digital video data R2G2B2 received from the system module 30 through the LVDS circuit into the modulation digital video data M(R2G2B2) through a data stretching method and then stores the modulation digital video data M(R2G2B2) in the internal memory 17. After k frame periods elapsed from immediately after a logic level of the selection signal SEL received from the system module 30 is inverted from the first logic level L to the second logic level H, the second controller 18 performs the modulation and storing operations so as to secure stable data. In particular, the second controller 18 inserts black data BD or displays the black image BLACK on the liquid crystal display panel 11 by turning off the light sources during k frame periods before and after a rising edge of the selection signal SEL, so as to remove the screen noise that is likely to be generated when the logic level of the selection signal SEL is inverted. After the modulation digital video data M(R2G2B2) is stored in the internal memory 17, the second controller 18 displays a stored image on the liquid crystal display panel 11 using the second sync signal SYNC2 synchronized with a frame frequency less than a frame frequency in the normal drive and drives the light sources using the dimming signal indicating a power-saving operation.

During the self-screen drive, the logic level of the selection signal SEL received from the system module 30 periodically varies, so that an image displayed on the liquid crystal display panel 11 is replaced. While the second controller 18 displays the black image BLACK for removing the screen noise on the liquid crystal display panel 11, the second controller 18 modulates second digital video data for update R2'G2'B2' received from the system module 30 through the LVDS circuit into modulation digital video data for update M(R2'G2'B2') through the data stretching method and then stores the modulation digital video data for update M(R2'G2'B2') in the internal memory 17. After the modulation digital video data for update M(R2'G2'B2') is stored in the internal memory 17, the second controller 18 displays a stored image on the liquid crystal display panel 11 using the second sync signal SYNC2 synchronized with a frame frequency less than a frame frequency in the normal drive and also drives the light sources using the dimming signal indicating a power-saving operation.

Power consumption in the self-screen drive is much lower than power consumption in the normal drive. Accordingly, because the liquid crystal display according to the embodiment of the invention displays an image at minimum power consumption, the liquid crystal display has an attractive appearance when it is not used and thus may contribute to an interior design. Namely, the liquid crystal display according to the embodiment of the invention may be implemented as an ultra power-saving TV contributing to an interior design. Because the liquid crystal display according to the embodiment of the invention modulates an image using the data stretching curve determined depending on a brightness of the image, the banding phenomenon of gray scale resulting from a reduction in the brightness of the light sources in the self-screen drive may be prevented and the average luminance of the image may increase.

Figure 8A:
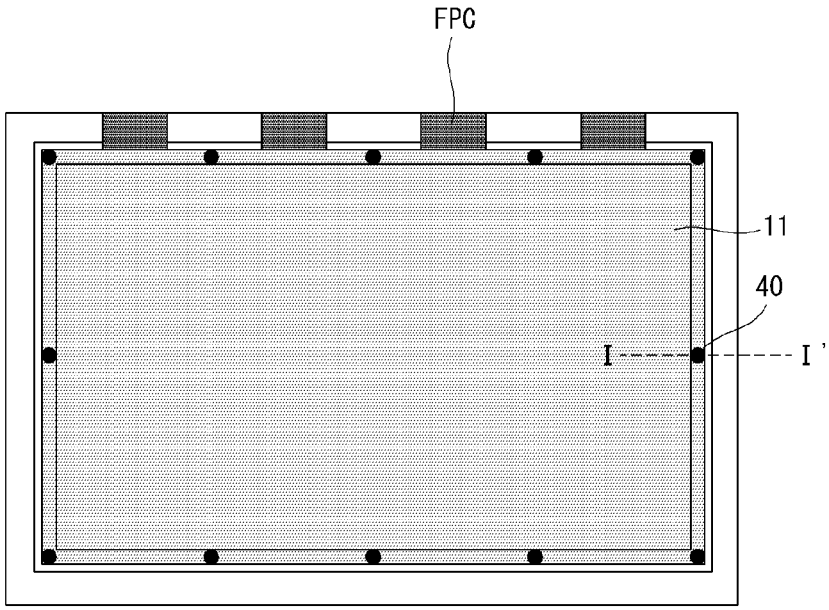
FIG. 8A is a plane view of a liquid crystal display including a touch sensor.
Figure 8B:
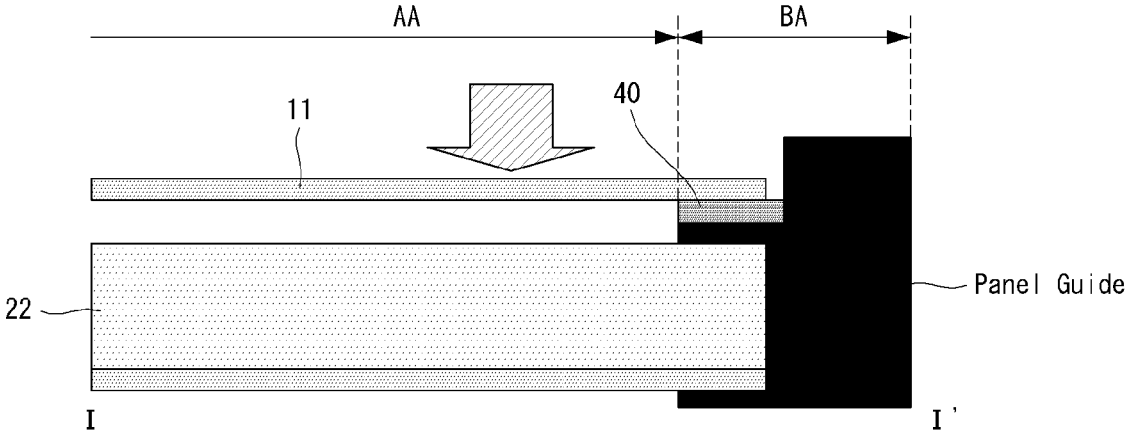
FIG. 8B is a cross-sectional view taken along line I-I' of FIG. 8A.
Figure 9A:
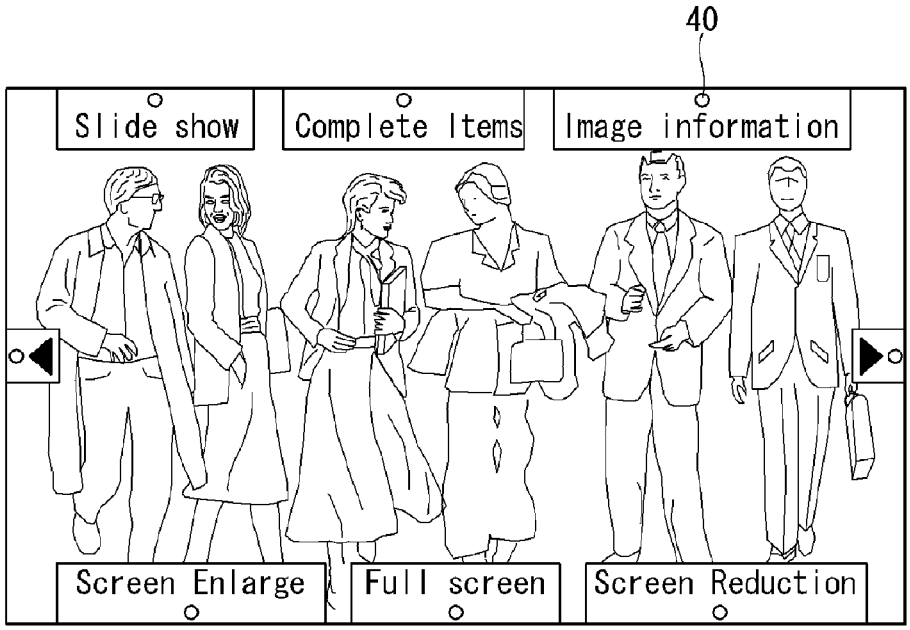
FIGS. 9A to 9C illustrate application examples of a liquid crystal display using a touch sensor.
Figure 9B:
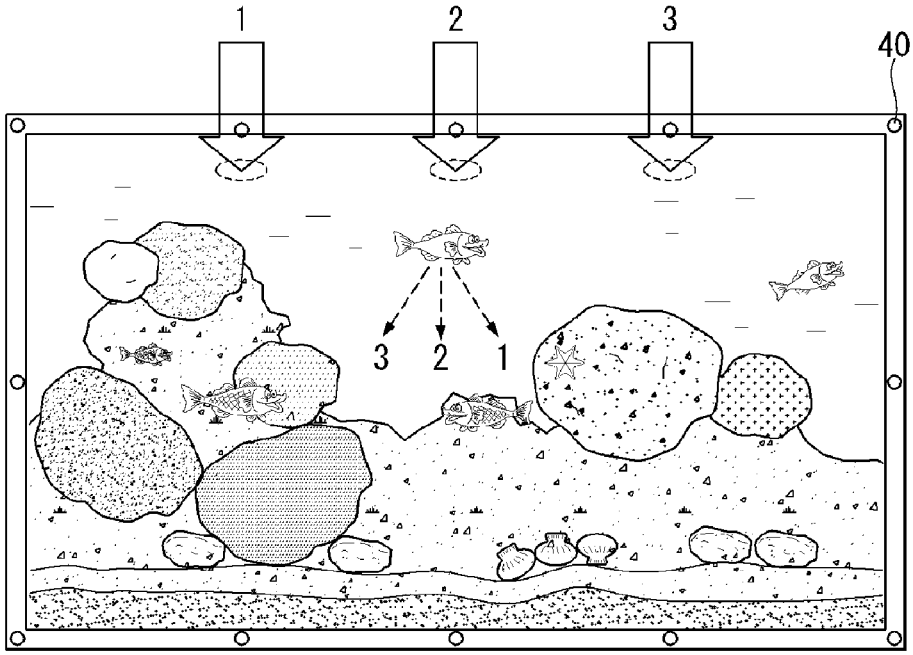
Figure 9C:
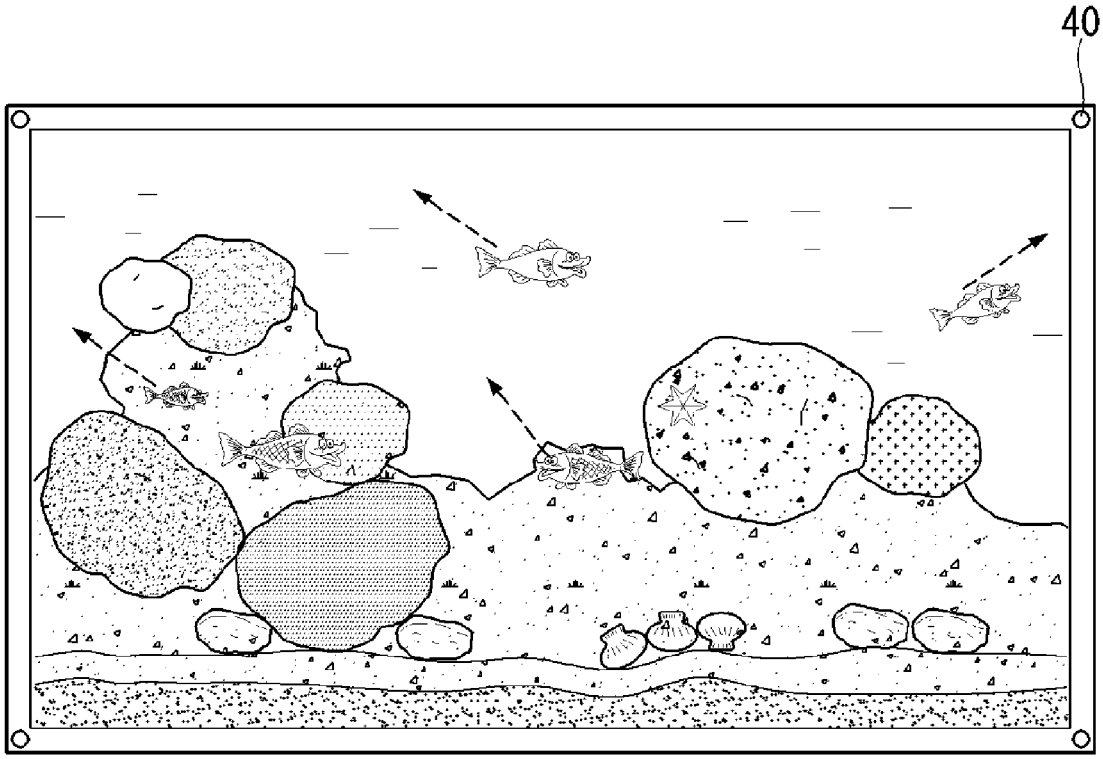

FIG. 8A is a plane view of a liquid crystal display including a touch sensor. FIG. 8B is a cross-sectional view taken along line I-I' of FIG. 8A. FIGS. 9A to 9C illustrate application examples of a liquid crystal display using a touch sensor.

As shown in FIGS. 8A and 8B, a liquid crystal display includes an effective display area AA in which an image is displayed and a non-display area BA outside the effective display area AA. A plurality of touch sensors 40 operating in response to a user's touch operation are positioned in the non-display area BA. The touch sensors 40 may be implemented as a well-known pressure sensor or button type sensor. The touch sensors 40 may be positioned under a liquid crystal display panel 11, so as to operate in response to a user's touch pressure applied to the liquid crystal display panel 11. For example, the touch sensors 40 may be positioned on a stepped jaw surface inside a panel guide on which the liquid crystal display panel 11 is loaded. The touch sensors 40 outputs a driving signal in response to the user's touch pressure applied to the liquid crystal display panel 11. In FIG. 8A, FPC indicates a flexible printed circuit for electrically connecting the liquid crystal display panel 11 to drive circuits. In FIG. 8B, a reference numeral 22 indicates a backlight unit.

The touch sensors 40 may be used in various applications.

As shown in FIG. 9A, in a case of a liquid crystal display in which a screen button is formed in a formation area of the touch sensor 40 and a simple command function usable as a digital photo frame is added, a function corresponding to an operation of the touch sensor 40 may be performed. For example, if a user touches a button of 'slide show', the liquid crystal display may enter a self-screen drive mode from a normal drive mode through an operation of the touch sensor 40 corresponding to the button. In other words, because the touch sensor 40 may perform several functions that were performed using an existing remote controller, the touch sensor 40 can contribute to user's convenience and can increase user's selection width.

Further, as shown in FIGS. 9B and 9C, there may occur changes in an image displayed on the screen of the liquid crystal display in the self-screen drive mode using the touch sensor 40. For example, in case an aquarium image is displayed on the screen of the liquid crystal display, a predetermined object of the aquarium image may move in a previously determined direction shown in FIG. 9B or in a nonuniform direction shown in FIG. 9C depending on a user's touch position, so that the aquarium image is made to look like a real aquarium. The movement of the predetermined object illustrated in FIGS. 9B and 9C may be embodied using a principle in which an image of a screen saver changes by following a movement of a mouse in a screen standby state of a computer.

As described above, because the liquid crystal display according to the embodiment of the invention displays an image at minimum power consumption, the liquid crystal display has an attractive appearance when it is not used and thus may contribute to an interior design. Namely, the liquid crystal display according to the embodiment of the invention may be implemented as an ultra power-saving TV contributing to an interior design.

Furthermore, because the liquid crystal display according to the embodiment of the invention modulates an image using the data stretching curve determined depending on a brightness of the image, the banding phenomenon of gray scale resulting from a reduction in the brightness of the light sources in the self-screen drive may be prevented and the average luminance of the image may increase.

Furthermore, because the liquid crystal display according to the embodiment of the invention includes the touch sensor, the user's convenience and the user's selection width may increase.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A liquid crystal display comprising:

a liquid crystal display panel;

a backlight unit that provides light to the liquid crystal display panel;

a panel drive circuit that drives signal lines of the liquid crystal display panel;

a timing controller that supplies a video signal to the panel drive circuit and controls an operation timing of the panel drive circuit;

a data stretching unit that modulates an internal video signal using a data stretching curve determined depending on a brightness of the internal video signal for a self-screen drive;

an internal memory that stores the modulated internal video signal;

a self-screen drive controller that generates a dimming signal having a dimming ratio less than a dimming ratio in a normal drive to reduce a luminance of the backlight unit and generates an internal timing signal to extract the modulated internal video signal from the internal memory;

a scaler unit that generates an external video signal and an external timing signal for the normal drive;

a selection unit that supplies one of an output of the self-screen drive controller and an output of the scaler unit to the timing controller in response to a mode selection signal;

an internal power circuit that generates driving voltages required to drive the panel drive circuit, the timing controller, and the self-screen drive controller;

an external power circuit that generates a power input to the internal power circuit and generates a power for driving the scaler unit; and a microprocessor that blocks an output of the external power circuit from being supplied to the scaler unit in the self-screen drive, wherein the data stretching unit fixes a slope of lower gray level, calculates an average luminance of the internal video signal corresponding to 1 frame, adjusts a slope of upper gray level between a previously set minimum slope and a previously set maximum slope depending on the calculated average luminance, and connects the fixed slope of lower gray level and the adjusted slope of upper gray level to determine a data stretching curve.

2. The liquid crystal display of claim 1, wherein the data stretching curve determined when the average luminance has a minimum value includes:

a first lower gray level curve including a first lower gray level range between a minimum gray level and a first middle gray level, a gray level on the first lower gray level curve changing between the minimum gray level and the first middle gray level at a fixed slope; and a first upper gray level curve that includes a first upper gray level range between the first middle gray level and a maximum gray level and is connected to the first lower gray level curve at a first intersecting point, a gray level on the first upper gray level curve changing between the first middle gray level and the maximum gray level at the previously set minimum slope less than the fixed slope.

3. The liquid crystal display of claim 2, wherein the data stretching curve determined when the average luminance has a maximum value includes:

a second lower gray level curve including a second lower gray level range between the minimum gray level and a second middle gray level less than the first middle gray level, a gray level on the second lower gray level curve changing between the minimum gray level and the second middle gray level at the fixed slope; and a second upper gray level curve that includes a second upper gray level range between the second middle gray level and the maximum gray level and is connected to the second lower gray level curve at a second intersecting point, a gray level on the second upper gray level curve changing between the second middle gray level and the maximum gray level at the previously set maximum slope that is less than the fixed slope and is greater than the previously set minimum slope.

4. The liquid crystal display of claim 1, wherein the data stretching unit analyzes a histogram of the internal video signal corresponding to 1 frame to calculate a reference gray level falling from a maximum gray level to T % (where T is a natural number equal to or less than 5), calculates an average luminance of the internal video signal corresponding to 1 frame, adjusts a slope of upper gray level between a previously set minimum slope and a previously set maximum slope depending on the calculated average luminance, and connects the reference gray level on an upper gray level curve to a minimum gray level point to determine a data stretching curve.

5. The liquid crystal display of claim 4, wherein the data stretching curve determined when the average luminance has a minimum value includes:

a first lower gray level curve including a first lower gray level range between a minimum gray level and the reference gray level, a gray level on the first lower gray level curve changing between the minimum gray level and the reference gray level at a first slope; and a first upper gray level curve that includes a first upper gray level range between the reference gray level and the maximum gray level and is connected to the first lower gray level curve at a first intersecting point, a gray level on the first upper gray level curve changing between the reference gray level and the maximum gray level at the previously set minimum slope less than the first slope.

6. The liquid crystal display of claim 5, wherein the data stretching curve determined when the average luminance has a maximum value includes:

a second lower gray level curve including a second lower gray level range equal to the first lower gray level range, a gray level on the second lower gray level curve changing between the minimum gray level and the reference gray level at a second slope less than the first slope; and a second upper gray level curve that includes a second upper gray level range equal to the first upper gray level range and is connected to the second lower gray level curve at a second intersecting point, a gray level on the second upper gray level curve changing between the reference gray level and the maximum gray level at the previously set maximum slope that is less than the second slope and is greater than the previously set minimum slope.

7. The liquid crystal display of claim 1, further comprising a plurality of touch sensors generating the mode selection signal in response to a user's touch operation.

8. The liquid crystal display of claim 1, wherein a dimming ratio of the dimming signal increases within a power consumption of 10% of a power consumption of the backlight unit operating at a maximum dimming ratio in the normal drive as an external illuminance increases.

* * * * *